US006527678B1

(12) United States Patent
Wang et al.

(10) Patent No.: US 6,527,678 B1
(45) Date of Patent: Mar. 4, 2003

(54) ELECTRIC TREADMILL TO WHOSE CONSOLE THE WEIGHT OF THE OPERATOR IS AUTOMATICALLY SENT

(76) Inventors: Leao Wang, No. 1, Lane 233, Sec. 2, Charng Long Rd., Taiping (TW), 411; Peter Wu, No. 1, Lane 233, Sec. 2, Charng Long Rd., Taiping (TW), 411

( * ) Notice: Subject to any disclaimer, the term of this patent is extended or adjusted under 35 U.S.C. 154(b) by 0 days.

(21) Appl. No.: 09/988,504

(22) Filed: Nov. 20, 2001

(51) Int. Cl.[7] ..... A63B 22/00
(52) U.S. Cl. ..... 482/51; 482/54
(58) Field of Search ..... 482/51, 54; 119/702, 119/703, 704

(56) References Cited

U.S. PATENT DOCUMENTS 4,332,217 A * 6/1982 Davis ..... 482/54
5,133,339 A * 7/1992 Whalen et al. ..... 482/54
6,234,111 B1 * 5/2001 Ulman et al. ..... 119/54
6,237,536 B1 * 5/2001 Lindvall ..... 119/528

* cited by examiner

*Primary Examiner*—Glenn E. Richman
(74) *Attorney, Agent, or Firm*—Troxell Law Office PLLC; Kuo-Hsiung Chiu

(57) ABSTRACT

The present invention relates to an electric treadmill to whose console the weight of the operator is automatically sent. The electric treadmill includes an upright frame, a base frame, a base and a rear supporting bar. A console is mounted on the upright frame, and a handrail is fitted to either side thereof. A motor-driven assembly is fitted to the base frame which a continuous belt circles for an in-place rotation. The electric treadmill includes a scale in connection with the console so that the weight parameter of the operator can be automatically fed into the console whereupon an optimal exercise session for the operator is automatically calculated by a built-in program.

6 Claims, 3 Drawing Sheets

ELECTRIC TREADMILL TO WHOSE CONSOLE THE WEIGHT OF THE OPERATOR IS AUTOMATICALLY SENT

BACKGROUND OF THE INVENTION

1. Field of the Invention

The present invention relates to an electric treadmill to whose console the weight of the operator is automatically sent, and more particularly, to a treadmill in which an optimal exercise session for the operator will be automatically calculated by a built-in program so that the present invention is practical and convenient in use.

2. Description of the Prior Art

A few personal details of the operator, such as age, sex, etc. can be fed into the console of the conventional electric treadmill before he takes the exercise session. Even, the desired duration of the exercise session or the desired consumption of calories can also be fed in the console, and the built-in program can calculate the optimal exercise session (including the exercise duration, speed, slope, etc.) in accordance with the fed-in data. Therefore, it's a user-oriented design. However, the parameters of age, sex or calorie represent great variables for different people. In brief, two persons with the same age and sex do not necessarily have the same or similar physical state. Thus, it doesn't meet the personal needs when one standard is applied to every operator.

SUMMARY OF THE INVENTION

It is a primary object of the present invention to remove the above-mentioned drawbacks and to provide an electric treadmill in whose console the weight parameter of the operator can be automatically fed in order to calculate an optimal exercise session for the operator.

It is another object of the present invention to provide an electric treadmill which includes a scale in connection with the console so that the operator can be easily and conveniently weighed before operation.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
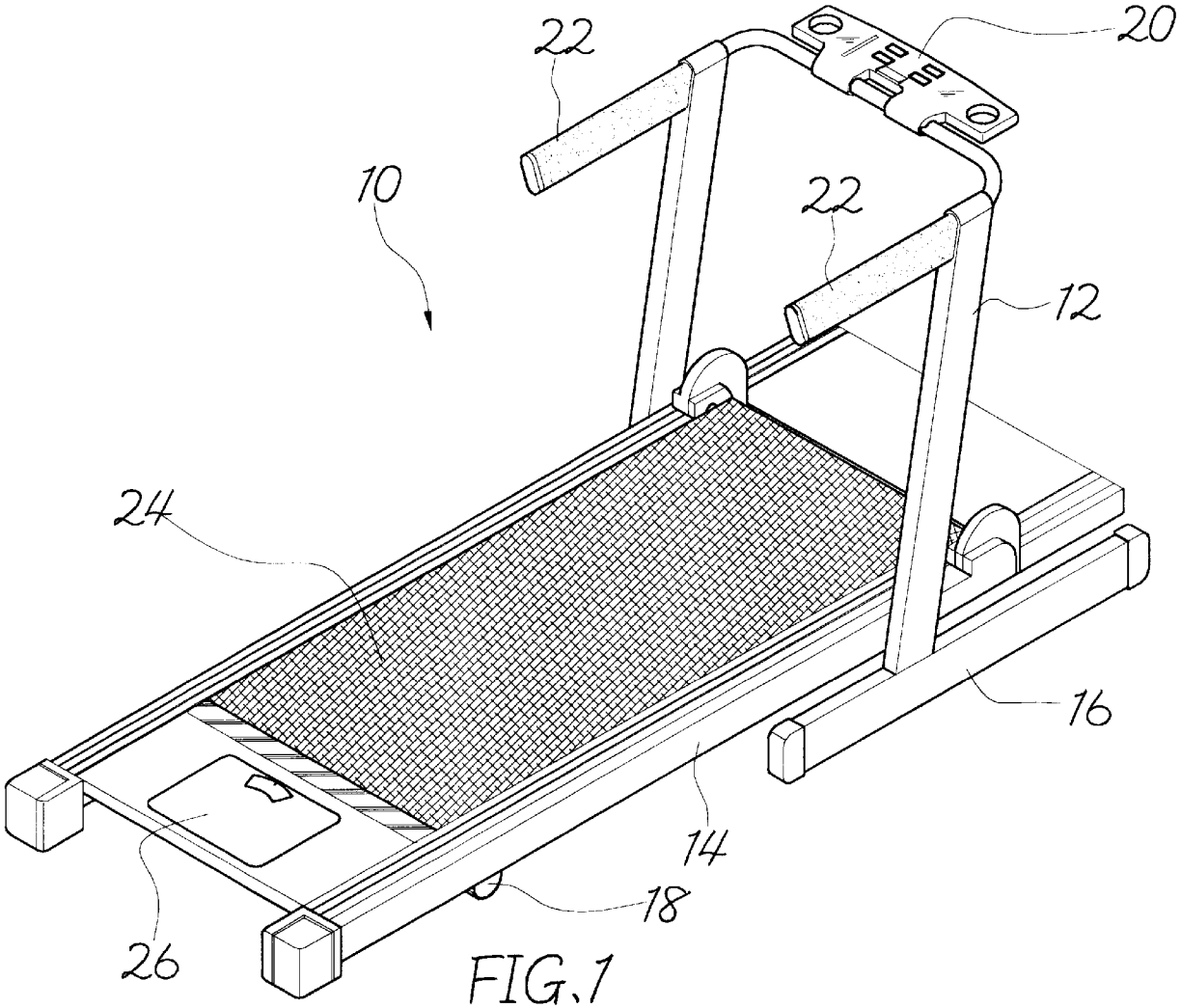
FIG. 1 is a perspective view of a preferred embodiment of the present invention.
Figure 2:
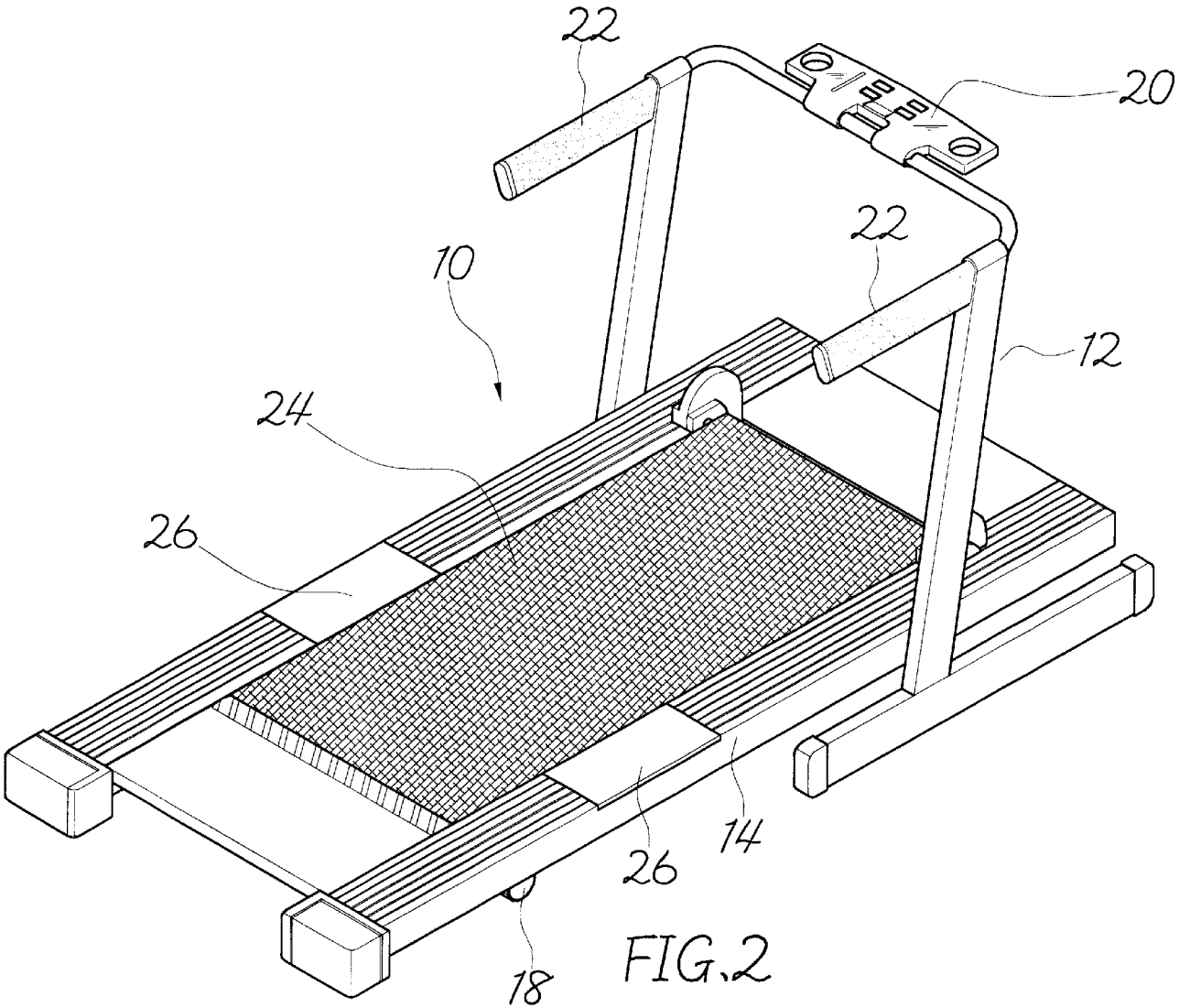
FIG. 2 is a perspective view of another preferred embodiment of the present invention.
Figure 3:
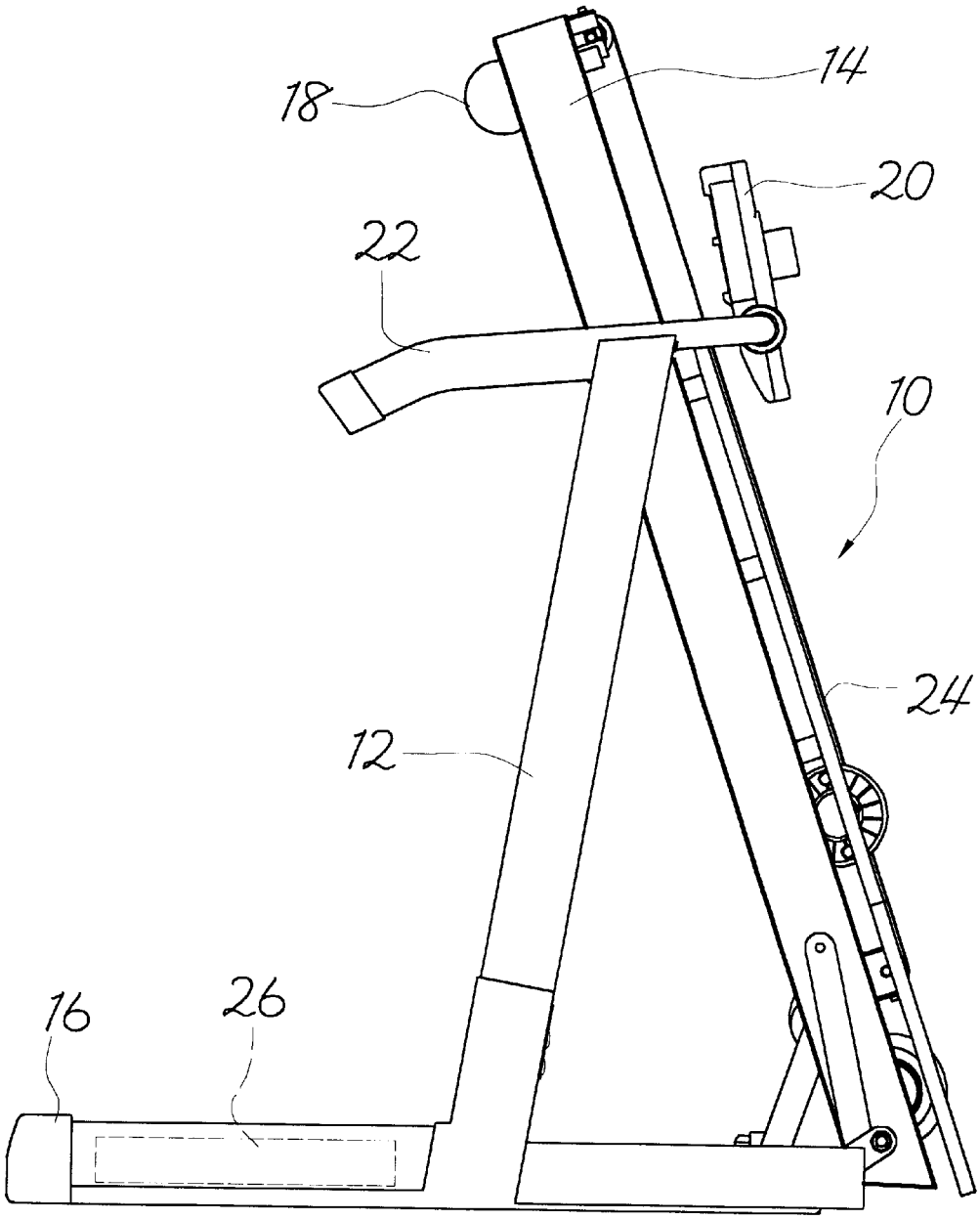
FIG. 3 is a perspective view of a further preferred embodiment of the present invention.

First of all, referring to FIGS. 1, 2 and 3, the electric treadmill 10 stated by the present invention includes an upright frame 12, a base frame 14, a base 16 and a rear supporting bar 18. A console 20 is mounted on the upright frame 12, and a handrail 22 is fitted to either side thereof. A motor-driven assembly (not shown) is fitted to the base frame 14 which a continuous belt (not shown) circles for an inplace rotation.

The electric treadmill 10 includes a scale 26 in connection with the console 20 so that the weight parameter of the operator can be automatically fed into the console 20 whereupon an optimal exercise session for the operator is automatically calculated by a built-in program.

As shown in FIGS. 1, 2 and 3, the present invention can be fitted to all kinds of the treadmills when it doesn't influence the operation of the user. The scale 26 can be disposed at the rear side (see FIG. 1), at two sides (see FIG. 2) of the base frame 14 or inside the base 16 (see FIG. 3) all of which can reach the expected effect.

The scale 26 and the console 20 can be connected through cable or by means of far infrared (in wireless way).

The built-in program doesn't belong to the scope of the present invention so that no further descriptions are given hereinafter.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. An exercise treadmill comprising:

a) a base;

b) an upright frame extending upwardly from the base, the upright frame including a handrail and a console;

c) a base frame connected to the base and including a movable endless belt; and, d) a weighing scale mounted on the base frame laterally displaced from the movable endless belt, the weighing scale being connected to the console.

2. The exercise treadmill of claim 1 wherein the weighing scale is connected to the console by a cable.

3. The exercise treadmill of claim 1 wherein the weighing scale is connected to the console by a wireless infrared device.

4. An exercise treadmill comprising:

a) a base;

b) an upright frame extending upwardly from the base, the upright frame including a handrail and a console;

c) a base frame connected to the base and including a movable endless belt; and, d) a weighing scale mounted inside the base and connected to the console.

5. The exercise treadmill of claim 4 wherein the weighing scale is connected to the console by a cable.

6. The exercise treadmill of claim 4 wherein the weighing scale is connected to the console by a wireless infrared device.

* * * * *